US005690093A

United States Patent [19]

Schrank et al.

[11] Patent Number: 5,690,093

[45] Date of Patent: Nov. 25, 1997

[54] VENTILATOR CONTROLLER WITH VARIABLY ADJUSTABLE FAN AND LIGHT

[75] Inventors: Anthony L. Schrank, Fairfield, Ohio; Robert Voosen, Randolph; Chris Hentschel, Kingston, both of Mass.

[73] Assignee: Nutone, Inc., Cincinnati, Ohio; a part interest

[21] Appl. No.: 375,554

[22] Filed: Jan. 19, 1995

[51] Int. Cl.[6] ..... F24C 15/20

[52] U.S. Cl. ..... 126/299 D; 126/299 R; 126/299 E; 454/67; 454/341; 454/343

[58] Field of Search ..... 126/299 K, 299 D, 126/299 E; 236/44 A; 454/67, 341, 343

[56] References Cited

U.S. PATENT DOCUMENTS

| | | | |
|---|---|---|---|
| 4,307,383 | 12/1981 | Brienza . | |
| 4,681,024 | 7/1987 | Ivey . | |
| 4,719,524 | 1/1988 | Morishima et al. . | |
| 4,856,493 | 8/1989 | Fleming et al. . | |
| 4,867,047 | 9/1989 | Citron . | |
| 4,920,253 | 4/1990 | Takei . | |
| 5,074,281 | 12/1991 | Fluhrer et al. | 126/299 D |
| 5,139,009 | 8/1992 | Watsh | 126/299 D X |
| 5,232,152 | 8/1993 | Tsang . | |
| 5,498,858 | 3/1996 | Jeong | 126/299 D X |

OTHER PUBLICATIONS

Leviton Mfg., "Instruction Manual for Part No. 6161" Push Button Dimmer.

*Primary Examiner*—Larry Jones
*Attorney, Agent, or Firm*—Wood,Herron & Evans, P.L.L.

[57] ABSTRACT

A range hood having a sleek, modern appearance has a keypad and control circuit which enable adjustment of fan speed and light intensity. The range hood includes a keypad having a linear array of keys which may be individually or collectively used to energize the fan at one of a variety of speeds. A control circuit responds to depression of one or a group of two of the keys and in response selects one of a plurality of possible fan speeds. The array of keys is also used in conjunction with a separate night light key to program the intensity of the light for use as a night light. An automatic shutoff key is used to gradually reduce the fan speed until, ultimately, the fan is deenergized.

22 Claims, 3 Drawing Sheets

VENTILATOR CONTROLLER WITH VARIABLY ADJUSTABLE FAN AND LIGHT

CROSS REFERENCE TO RELATED APPLICATION

This application is related to design patent application Ser. No. 29/025638 for "KITCHEN RANGE HOOD" of Anthony L. Schrank and Walter L. Bohl, Jr., which is assigned to the same assignee as the present application and is incorporated by reference herein in its entirety.

FIELD OF THE INVENTION

The present invention relates to controllers for lights and fans in ventilators for human-habitable structures, such as kitchen range hoods.

BACKGROUND OF THE INVENTION

A modern kitchen typically includes a hood mounted above the range. The range hood serves two purposes: First, the hood includes a fan coupled to a duct leading outdoors to vent cooking odors and smoke away from the cooking surface. Second, the hood often includes a light to illuminate the cooking surface.

Typically, while cooking a meal, both the light and fan are energized. After the meal is cooked, the user often leaves the fan energized to continue evacuating smoke or cooking odors until these are fully dissipated, returning later (after the meal is served) to deenergize the fan. Typically, the light will be extinguished when cooking is finished, but some users have been known to leave the light energized to serve as a kitchen night light.

SUMMARY OF THE INVENTION

The invention provides an improved range hood which meets the needs of a modern kitchen.

Specifically, it is desirable to enable adjustment of the speed of the range hood fan. A fan speed sufficient to vent strong odors or large quantities of smoke is typically far greater than is needed in most cooking applications. Similarly, it is desirable to enable adjustment of the intensity of the range hood light. While an intense range hood light facilitates cooking, relatively dimmer light is desirable when the range hood light is used as a night light for the kitchen area.

In the past, wall-mounted light switches (and other household circuitry) have been equipped with adjustable switches. Typically, the adjustable switch includes a potentiometer mounted to a rotating knob or a slider; the knob or slider projects out of a wall-mounted switch plate and can be manually manipulated by the homeowner.

This type of adjustable switch, while in common use in wall-mounted switches, is not necessarily desirable for a range hood. Recently, consumers have shown a desire for kitchen appliances with sleek, uncluttered surfaces. Such appliances have a stylish, modern appearance, and can be cleaned more easily. Refrigerators, ranges, dishwashers and the like have recently been styled with these needs in mind. As a result, consumers may find a range hood with rotating knobs or sliders undesirable, because such a range hood would not match other kitchen appliances, and would be difficult to clean.

The present invention provides a range hood with adjustable fan speed and light intensity, without compromising the functional and stylistic desire for a sleek, modern appearance.

Specifically, in one aspect a range hood in accordance with principles of the present invention includes keypad having a plurality of keys which may be individually or collectively used to energize the fan at one of a variety of speeds. A control circuit responds to depression of one or a plurality of the keys and in response selects one of a plurality of possible fan speeds.

The keys may, for example, be arranged in a linear array, with the lowest fan speed at one end of the array and the highest fan speed at the opposite end of the array, so that the user depressing one or more keys at any position in the array will produce a fan speed related to the position of the user's finger along the array.

In another aspect, the range hood makes use of a similar keypad to control the intensity of the range hood light. The keys may be arranged in a linear array as described above or in any other suitable manner.

A single keypad may be used to adjust both the fan speed and the night light intensity. For example, the keypad may include an array of keys, and a separate NITE key. When the NITE key is depressed in combination with key(s) in the array, the control circuit programs the night light intensity, but when key(s) in the array are depressed alone, the control circuit adjusts the fan speed. The NITE key, when actuated alone, energizes the light at the preprogrammed night light intensity. (Additional light keys energize the light at full intensity, and deenergize the light, without changing the programmed night light intensity.)

In a third aspect, the keypad may include a fan control key used to automatically adjust the fan speed. When this key is depressed the control circuit automatically adjusts the fan speed over time in accordance with a preprogrammed schedule. In one specific application, this key is used for automatic shutoff: upon depression of the automatic shutoff key the control circuit gradually reduces the fan speed until, ultimately, the fan is deenergized. This saves the user from returning to the kitchen to deenergize the fan after serving a meal, and also provides for automatic gradual reduction in the fan speed after cooking is completed as odors and smoke dissipate.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
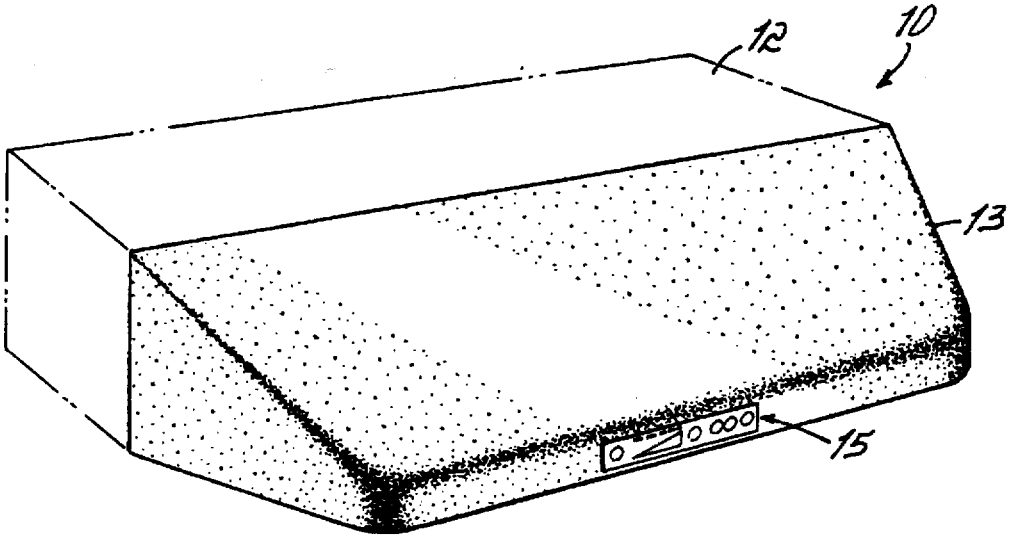
FIG. 1 is a perspective view of a kitchen range hood in accordance with principles of the present invention.

Referring to FIG. 1, a range hood 10 in accordance with the principles of the present invention includes a rear section 12 for mounting over a stove or other cooking device, containing a fan motor for evacuating air from the cooking device, and a front area 13 including a light for illuminating the cooking device and control circuitry discussed below. On front area 13 is a keypad 15 containing function keys for controlling operation of the range hood as discussed further below.

Figure 2:
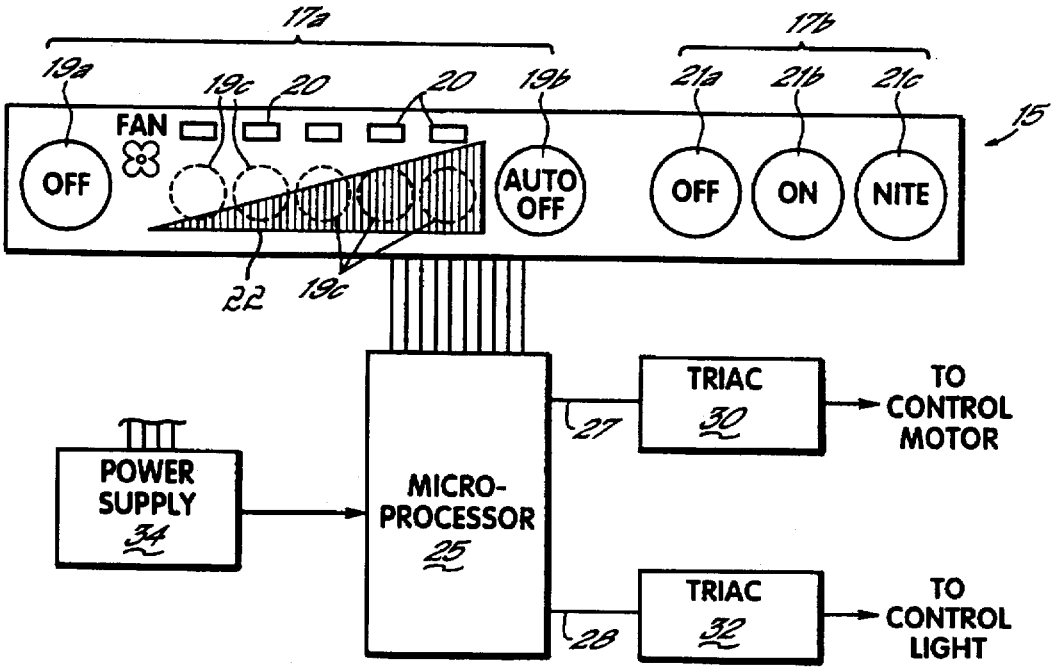
FIG. 2 is block circuit diagram of a control circuit for a kitchen range hood in accordance with principles of the present invention.

Referring to FIG. 2, keypad 15 includes ten keys which are depressed by the user to control the operation of the fan and light of range hood 10. The keys in section 17*a* relate to the control of the fan of range hood 10, whereas the keys in section 17*b* relate to the control of the light in range hood 10.

Each of the keys on keypad 15 is a pressure sensitive switch taking the form of a circular pad. Overlaying keypad 15 is a printed template including circles indicating the locations of the underlying keys, and text indicating the functions of the keys, such as OFF, FAN, AUTO OFF, ON and NITE. The location of the keys under the printed template is indicated in FIG. 2 by dotted outlines. Further, a portion of the template is cut away in FIG. 2, exposing the keys residing beneath the template.

The locations of the five FAN keys 19*c* are not explicitly indicated in the template, but rather this section of the template includes a wedge shaped symbol 22. The meaning of this symbol will be elaborated below.

The fan control keys 17*a* include a fan OFF key 19*a* for immediately deenergizing the fan, an AUTO OFF key 19*b* for gradually deenergizing the fan over a time period, and five FAN keys 19*c* arranged in an array between OFF key 19*a* and AUTO OFF key 19*b*, which are used to energize the fan.

To energize the fan, the user presses the keypad on the wedge-shaped symbol, thereby pressing one or two of the FAN keys 19*c*. In response, the control circuitry shown in FIG. 2 energizes the fan to a speed determined by which of the five FAN keys 19*c* was depressed, as discussed further below. To deenergize the fan, the user presses the fan OFF key 19*a* to deenergize the fan immediately. Alternatively, the user may press the AUTO OFF key 19*b* which causes the control circuit of FIG. 2 to gradually reduce the fan speed until the fan is deenergized.

The light control keys 17*b* include a light OFF key 21*a*, a light ON key 21*b*, and a NITE key 21*c*. To deenergize the light the user presses the light OFF key 21*a*. To energize the light the user presses the light ON key 21*b*. To energize the light to a low night light level the user presses the NITE key 21*c*. The user may also program the intensity of the night light by pressing the NITE key 21*c* in combination with one of the FAN keys 19*c*. The details of this operation are discussed in further detail below.

Keypad 15 also includes five light emitting diodes 20, which are respectively located above each of the five FAN keys 19*c*. These light emitting diodes illuminate to provide visual feedback on the selected fan speed and night light intensity level, as described in detail below.

Electrical switches formed by the ten keys on keypad 15 are connected in a key matrix, as is known in the art. This matrix is scanned by microprocessor 25 to determine which, if any, of the keys on keypad 15 have been depressed. The key strokes on keypad 15 are then processed as described below in connection with FIG. 3.

Microprocessor 25 includes output lines 27 and 28 through which it controls a triac 30 for controlling the motor speed and a triac 32 for controlling the light intensity. Microprocessor 25 and the remaining circuitry of range hood 10 are supplied with power from a power supply 34.

Microprocessor 25 may be any suitably programmed microprocessor having sufficient input and output lines to scan keys on keypad 15 and produce control signals on lines 27 and 28 to control triacs 30 and 32. One particularly suitable microprocessor is the family of microcontrollers sold by Microchip Technology Inc. of 2355 W. Chandler Blvd., Chandler, Ariz. 85224-6199 under the part numbers PIC16xxx. These microcontrollers have a large number of input and output ports, are easily factory or user-programmable, and are relatively inexpensive.

Figure 3A:
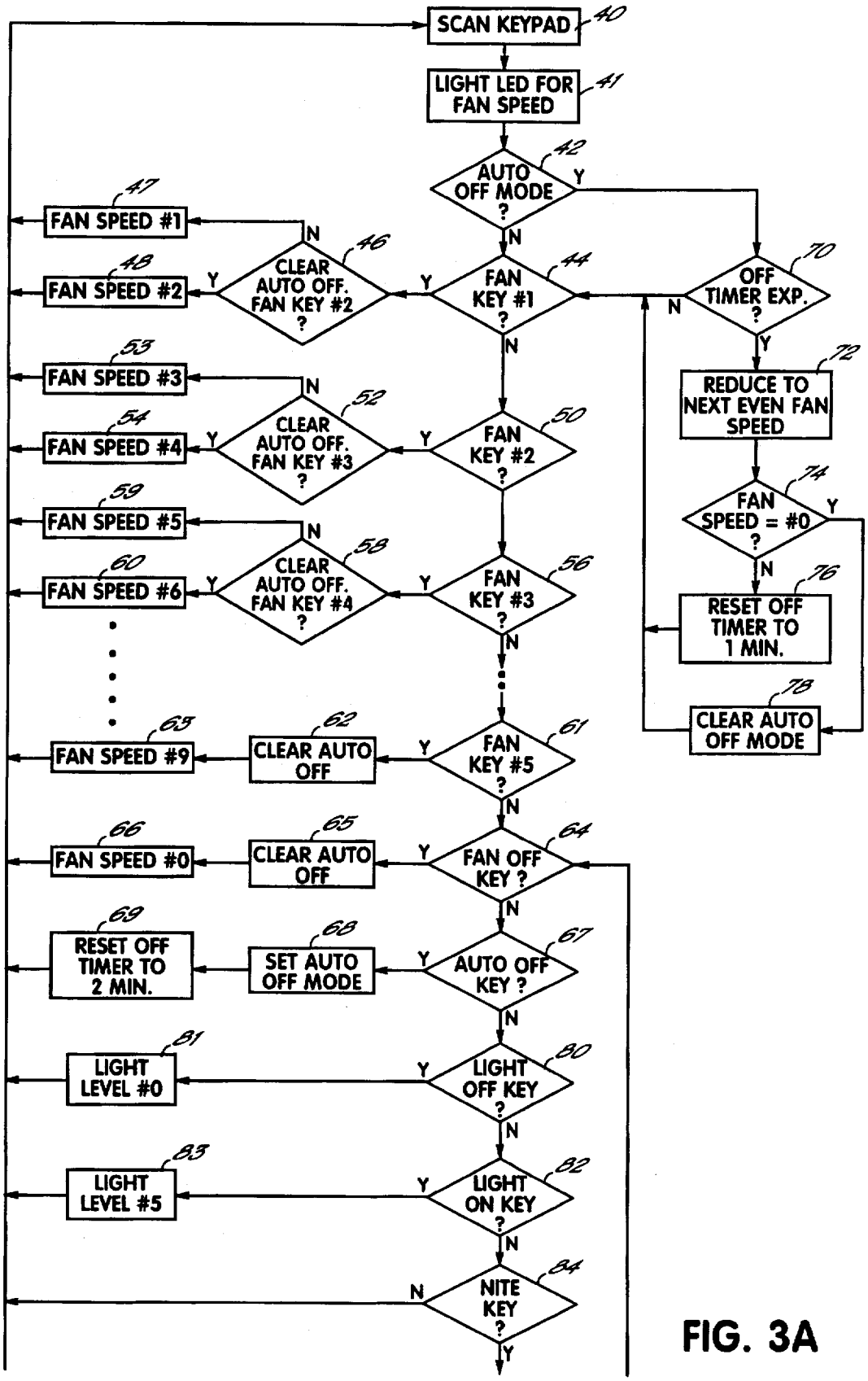
FIGS. 3A and 3B are a flow chart of operations performed by the microprocessor 25 of FIG. 2 in response to keystrokes on keypad 15 of FIG. 2.
Figure 3B:
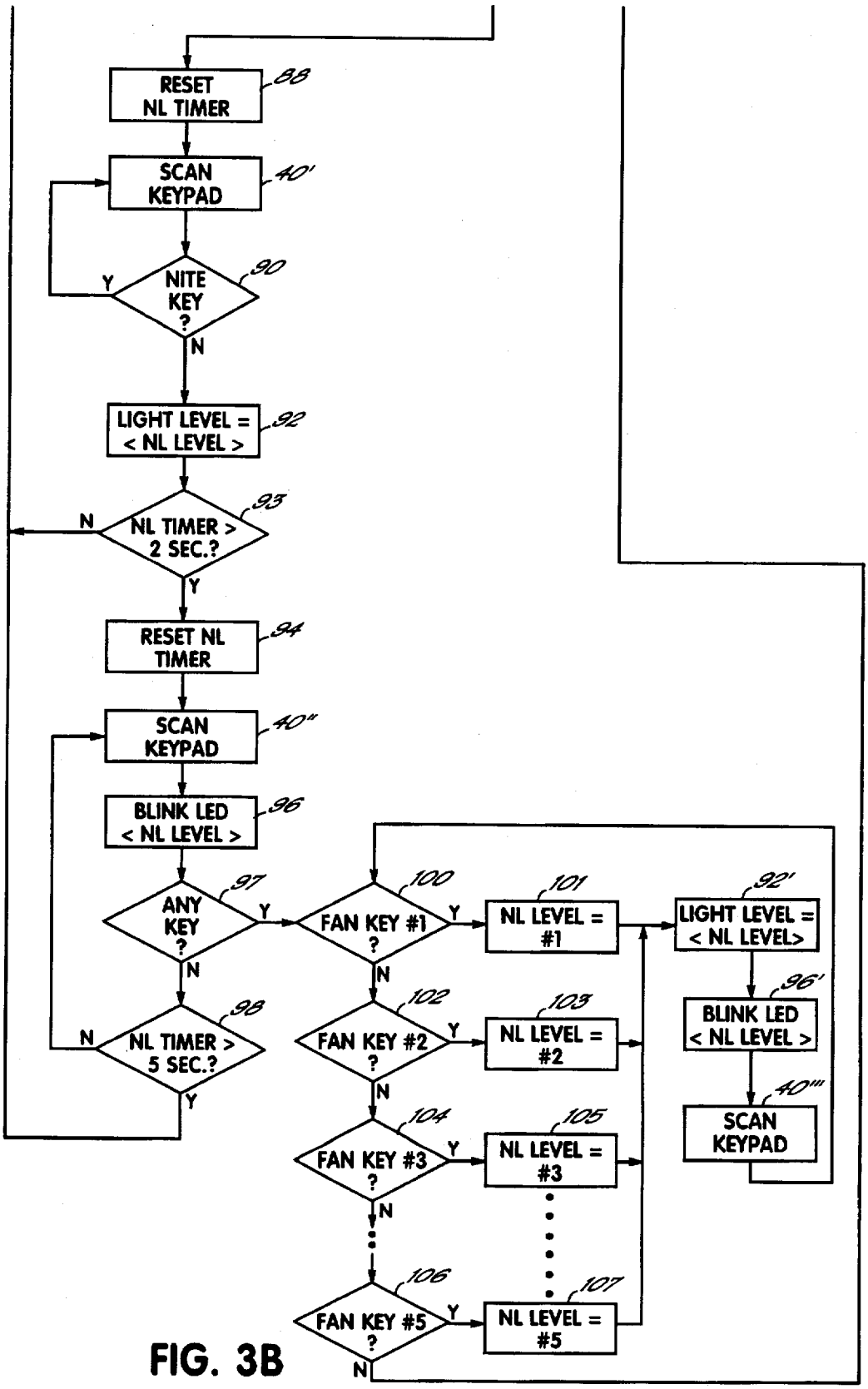

Referring to FIGS. 3A and 3B, the programming in microprocessor 25 follows a loop which begins at a step 40, in which microprocessor 25 scans the keys on keypad 15 to determine which, if any, of the keys are pressed. Then in subsequent steps in the loop, microprocessor 25 determines which key is pressed and takes the appropriate action.

Microprocessor 25 can be put into a special auto-off mode in response to depression of the AUTO OFF key 19*b*. The mode of the microprocessor 25 may be stored by, for example, setting or clearing flag bits in a memory location in microprocessor 25. The significance of the auto-off mode and the manner in which microprocessor 25 enters and exits this mode is discussed in detail below.

After scanning 40 the keypad, microprocessor 25 first illuminates the appropriate LED 20 on the keypad, as determined by the current fan speed. As noted in further detail below, there are nine fan speeds that can be selected by the user. Fan speeds #1 and #2 (the lowest fan speeds) are indicated by illuminating the leftmost LED in keypad 15. Fan speeds #3 and #4 are indicated by illuminating the second LED from the left on keypad 15, and so on. Fan speed #9 (the highest fan speed) is indicated by illuminating the LED on the far right in keypad 15.

Next, microprocessor 25 determines 42 whether it has been put into the auto-off mode. If the microprocessor 25 is not in the auto-off mode. The operations invoked in auto-off mode are discussed in detail below. If the microprocessor is not in auto-off mode, it then determines 44 whether FAN key #1 (the FAN key to the left in keypad 15) has been depressed. If FAN key #1 has been depressed, microprocessor 25 then determines 46 whether the FAN key #2 (the second FAN key from the left in keypad 150) is depressed. If FAN key #1 is depressed but FAN key #2 is not depressed, microprocessor 25 proceeds to step 47, placing the fan in the lowest fan speed setting, i.e., fan speed #1. If FAN key #1 and FAN key #2 are depressed, microprocessor 25 proceeds to step 48 and places the fan in the second fan speed, fan speed #2. In either case, after setting the fan speed, microprocessor 25 returns to beginning 40 of the loop.

If FAN key #1 is not depressed in step 44, microprocessor 25 proceeds to determine 50 whether FAN key #2 is depressed. If FAN key #2 is depressed, microprocessor 25 determines 52 whether FAN key #3 is depressed. If FAN key #2 is depressed, but FAN key #3 is not depressed, microprocessor 25 proceeds to step 53 and sets the fan speed to the third fan speed, fan speed #3. If the second and third FAN keys are depressed, microprocessor 25 proceeds to step 54, setting the fan speed to the fourth fan speed, fan speed #4.

In a similar fashion, if FAN key #2 is not pressed in step 50, microprocessor 25 proceeds to determine 56 whether FAN key #3 is depressed, and if so, determine 58 whether FAN key #4 is depressed, and as a result sets the fan speed to either the fan speed #5 in step 59 or fan speed #6 in step 60.

As a result of the process described above, the user may press his/her finger in any position of keypad 15 along the array of FAN keys 19*c*, and control the fan speed in accordance with the position of his/her finger. If the user presses one of the FAN keys 19c or depresses two of the keys 19c, the fan speed will be set to an appropriate level corresponding to the position of the user's finger. The process described above establishes one fan speed for each FAN key 19c when depressed alone, and one fan speed for each pair of keys when depressed simultaneously. Since there are five keys 19c on keypad 15, there are nine corresponding fan speeds that can be determined by depressing one or an adjacent pair of FAN keys 19c.

The process described above in connection with steps 44–60 is applied to each of the FAN keys #1, #2, #3, #4, #5 and each of pair of FAN keys #1–#2, #2–#3, #3–#4 and #4–#5, so that one of nine possible fan speeds is selected based upon which combinations of FAN keys 19c are depressed. This process terminates at step 61 in which microprocessor 25 determines whether FAN key #5 is depressed, and if so, proceeds to step 63, setting the fan speed to the highest fan speed, fan speed #9.

If none of the FAN keys are depressed, microprocessor 25 will proceed through steps 44, 50, 56 and through step 61, arriving at step 64. At this step, microprocessor 25 determines if the fan OFF key 19a has been depressed. If so, microprocessor 25 proceeds to step 66, setting the fan speed to fan speed #0, i.e. deenergizing the fan.

If, however, the fan OFF key is not depressed, microprocessor 25 proceeds to step 67, determining whether the AUTO OFF key 19b is depressed. If so, microprocessor 25 sets 68 the auto-off mode to cause gradual reduction in the fan speed, as discussed above and elaborated below. Subsequently, microprocessor 25 resets 69 an off timer to two minutes. This timer, which is internal to microprocessor 25 and driven by the clock controlling microprocessor 25, counts down a programmed interval from the moment at which it is reset. This time interval is used as described below to slowly reduce the fan speed. After thus resetting the timer, microprocessor 25 returns to the top 40 of the loop.

Once microprocessor 25 has been put in the auto-off mode in step 68, during each subsequent iteration of the loop of FIG. 3, microprocessor 25 will proceed from step 42 to step 70, rather than directly to step 44. Step 70 is the beginning of a routine in which the fan speed is slowly reduced. In step 70, microprocessor 25 determines if the off timer has expired. If the off timer has not expired, microprocessor 25 immediately proceeds to step 44. However, if the off timer has expired, microprocessor 25 proceeds to step 72 in which microprocessor 25 reduces the fan speed. The fan speed is reduced to the next lower even fan speed. Thus, for example, if the fan speed at setting #5, step 72 will reduce the fan speed to setting #4. After thus reducing the fan speed, microprocessor 25 determines 74 whether the fan speed has reached fan speed #0, i.e. whether the fan has been deenergized. If not, microprocessor 25 resets 76 the off timer to an interval of one minute, and then proceeds to step 44. However, if the fan speed has reached zero, microprocessor 25 clears 78 the auto-off mode, and then proceeds to step 44.

As a result of steps 70–78, once microprocessor 25 has been placed in auto-off mode, it will reduce the fan speed by one increment over a span of several minutes, until the fan is deenergized. Microprocessor 25 will remain in auto-off mode until the fan speed has been reduced to fan speed #0, at which time microprocessor 25 will exit auto-off mode.

The user may also cancel the auto-off mode by pressing any of the FAN keys 19c. It should noted that in steps 46, 52 and 58 and 62 discussed above, microprocessor 25 clears the auto-off mode if it has been engaged. Thus, for example, if the user presses FAN key #3 after pressing the AUTO OFF key, microprocessor 25 (after, e.g., steps 42, 70, 72, 74, 76, 44 and 50) will arrive at step 56. At this step, microprocessor 25 will determine that FAN key #3 has been depressed, and will proceed to step 58, as discussed above. In step 58, microprocessor 25 clears the auto-off mode, and then determines whether FAN key #2 is depressed, so that it may subsequently proceed to either step 59 or 60 and set the fan speed accordingly. However, since the auto-off mode has been cleared in step 58, the fan speed will no longer be gradually reduced by operation of steps 70–78. Rather, microprocessor 25 will thereafter proceed directly from step 42 to step 44 and skip steps 70–78.

Further, it should be noted that pressing the fan OFF key 19a also causes microprocessor 25 to clear the auto-off mode, in that as microprocessor 25 proceeds from step 64 to step 66, it also clears the auto-off mode in step 65.

Now proceeding on the flow chart of FIG. 3, if at step 67 the auto-off key is not depressed, microprocessor 25 will proceed to determine 80 whether the light OFF key 21a is depressed. If so, microprocessor 25 will set 81 the intensity of the light to level #0, i.e. it will deenergize the light. If, however, the light OFF key is not depressed microprocessor 25 will determine 82 if the light ON key 21b is depressed. If so, microprocessor 25 will set 83 the intensity of the light to level #5, i.e. the light will be put at full intensity.

If neither the light ON key nor the light OFF key is depressed, microprocessor 25 will proceed to determine 84 whether the NITE key 21c is depressed. NITE key 21c performs two functions. If NITE key 21c is pressed and released in a short interval of time, it will energize the light to a preprogrammed night intensity level. If the NITE key is pressed and held for longer than a predetermined period, microprocessor 25 will enter a night light adjustment mode in which the user may set the night light intensity level by pressing one of the FAN keys 19c. The programmed intensity level is determined from which of the keys 19c is depressed, as discussed below. The new intensity level is stored in memory so that it will remain programmed until it is reprogrammed by the user.

To determine whether the user intends to program the night light intensity or merely energize the light at the preprogrammed intensity, microprocessor 25 enters a timing loop when the NITE key 21c is depressed. This timing loop is used to determine the length of time for which the NITE key 21c is depressed and thereby determine whether the user intends to program the night light intensity or alternatively only intends to energize the light at its preprogrammed night intensity.

If the night light key is depressed, microprocessor 25 first resets 88 an internal night light (NL) timer. Next, microprocessor rescans 40' the keyboard, and then determines 90 whether the NITE key 21c is still depressed. If the NITE key is still depressed, microprocessor 25 returns to step 40' and again rescans the keypad. Only when the NITE key is released, microprocessor 25 proceeds from step 90 to step 92, at which the light is energized at the preprogrammed night intensity.

After step 92, microprocessor 25 proceeds to step 93, at which it determines if the NL timer exceeds 2 seconds. If the user pressed the NITE key 21c for longer than two seconds, microprocessor 25 determines that the user intends to program the night light intensity, and proceeds to step 94 and subsequent steps in which the night light intensity is programmed, as described below.

If, however, the NITE key 21c is released before 2 seconds elapse, microprocessor 25 detects this in step 93 of loop, and determines from this that the user does not wish to program the night light intensity level, but rather wishes to only energize light at night intensity. As a result, microprocessor 25 returns to the top 40 of the main loop.

When the user has initiated programming of the night light intensity, microprocessor 25 signals this to the user by blinking an LED 20 for a period of five seconds. If at any time during these five seconds, the user presses one of the FAN keys 19*c*, the microprocessor will reprogram the night light intensity to a level corresponding to the location of the pressed FAN key, as described below. However, if no keys are pressed for five seconds, or if a key other than a FAN key is pressed, microprocessor terminates programming of the night light intensity, and resumes normal operation.

These functions are carried out by steps 94 and the steps which follow.

In step 94, microprocessor 25 begins the five second interval by resetting the night light timer NL Timer. Then, microprocessor 25 proceeds to step 40", in which the keyboard is rescanned to determine if any keys are being pressed. Subsequently, in step 96, microprocessor 25 determines if any keys are pressed. If so, microprocessor 25 proceeds to step 100 to evaluate the key which is pressed. However, if no keys are pressed, microprocessor proceeds to determine 98 whether five seconds have elapsed. If not, microprocessor returns to step 40" to rescan the keyboard and restart the loop. However, if at step 98 five seconds have elapsed, no key has been pressed for five seconds, and therefore microprocessor 25 cancels the night light intensity programming by returning to the top 40 of the loop.

During each cycle of the loop described in the previous paragraph, microprocessor 25 passes through step 96, in which microprocessor "blinks" one of the LEDs 20 in keypad 15. There are five available night light intensities, one associated with each of the five FAN keys 19*c*. Thus, to indicate the currently selected night light intensity, microprocessor 25 "blinks" the LED 20 in a position relative to the other LEDs which corresponds to the current intensity of the night light relative to the four other intensities. For example, if the current night light intensity is level #3, LED #3 "blinks".

Microprocessor 25 "blinks" a selected LED by turning the LED on and off over a suitable time interval that is perceptible to a user. This can be done in response to the night light timer or any other timer in the microprocessor. For example, to create a one-second blink, during each visit to step 96, the "blinking" LED might be illuminated if the timer has an odd number of seconds and extinguished if the timer has an even number of seconds. Other blink intervals can be created by dividing each second into intervals, during some intervals the LED is illuminated and during some intervals the LED is extinguished.

As noted above, if the user presses a key during the five-second programming interval, microprocessor 25 proceeds to step 100 to evaluate which key was pressed. The FAN keys 19*c* may be used to program the night light level. If FAN key #1 is depressed, this indicates that the user desires to set the night light intensity level to night light intensity level #1. Accordingly, microprocessor 25 sets 101 the night light intensity level to level #1. Then, to provide the user feedback on the programmed night light intensity level, microprocessor 25 sets 92' the light level to the thus programmed night light intensity level, and then "blinks" 96' the LED corresponding to the selected intensity level.

Alternatively, if FAN key #1 is not pressed, microprocessor 25 determines 102 whether FAN key #2 is depressed. If FAN key #2 is depressed, microprocessor 25 sets 103 the night light intensity level to level #2. Microprocessor 25 then proceeds to set 92' the light level to the thus programmed night light intensity level and "blink" 96' the corresponding LED.

Further, if FAN key #2 is not pressed, microprocessor 25 determines 104 that FAN key #3 is depressed. If FAN key #3 is pressed, microprocessor 25 sets 105 the night light intensity level to level #3, and then proceeds to set 92' the light level to the thus programmed night-light level and "blink" 96' the corresponding LED.

Similar steps to steps 100–105 are followed until microprocessor 25 arrives at step 106 in which it determines if FAN key #5 is pressed. If FAN key #5 is depressed, microprocessor 25 sets 107 to the night light intensity level to level #5, and so on.

However, if at step 106 FAN key #5 is not depressed, then none of the FAN keys were depressed. In this case, microprocessor 25 proceeds to step 64 to determine whether any keys other than the FAN keys are pressed, and if so to take the appropriate action.

After microprocessor 25 sets 92' the night light intensity to the level indicated by the user, and "blinks" 96' the corresponding LED, microprocessor 25 proceeds to rescan 40'" the key board and return to step 100. The keyboard is rescanned for two purposes. First, if the user wishes to change the programmed night light intensity level, the user may hold his/her on the keypad, and slide to a different FAN key 19*c*. The movement to a new FAN key 19*c* is detected when the keyboard is rescanned 40'". Furthermore, it is necessary to wait until the user has released all of the FAN keys before returning to the top 40 of the loop so that the depression of a FAN key is not confused with an attempt to energize the fan.

After the keyboard has been rescanned 40'", microprocessor 25 returns to step 100 to test if FAN key #1 is now depressed and thereafter to determine if FAN keys 2–5 are now depressed. Whichever FAN key is depressed, the appropriate night light intensity level is set, the light level is set to a new night light intensity level, and the appropriate LED blinks. As a result, after first reprogramming the intensity level, the user may move his/her finger along the FAN keys 19*c* to adjust the reprogrammed intensity to the desired level.

Eventually, when the user is satisfied with the programmed intensity level, the user will remove his/her finger from the keypad and release all of the FAN keys. At this point, microprocessor 25 will proceed through steps 100, 102, 104 and 106, and directly to step 64, thus restarting normal analysis and processing of keystrokes.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art.

For example, microprocessor 25 may be programmed with a test mode invoked upon a special combination of keystrokes (or perhaps one or more keystrokes made when power is initially supplied). This test mode may (a.) illuminate the LEDs in sequence to facilitate testing of their operation, (b.) provide feedback upon sequential depression of the keys to test the keypad, and (c) sequentially select each possible fan speed and light intensity to test the fan and light control.

The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A ventilator for a human-habitable structure, comprising a fan motor, a fan driven by said fan motor, a control circuit electrically connected to said fan motor for providing electrical power to said fan motor, a keypad including a plurality of adjustment keys electrically coupled to said control circuit, said control circuit responding to simultaneous depression of a group of at least two of said adjustment keys and in response causing said fan motor to drive said fan at one of a plurality of possible fan speeds.

2. The ventilator of claim 1 wherein said adjustment keys are arranged in a linear array having first and second ends, said control circuit responding to depression of a key at said first end of said array by causing said fan motor to drive said fan at a lowest possible fan speed, and said control circuit responding to depression of a key at said second end of said array by causing said fan motor to drive said fan at a highest possible fan speed.

3. The ventilator of claim 2 wherein respective keys in said array from said first end to said second end are associated with respective monotonically increasing fan speeds, whereby depressing a key at any position in the array will produce a fan speed related to the position of the depressed key along the array.

4. A ventilator for a human-habitable structure, comprising a fan motor, a fan driven by said fan motor, a control circuit electrically connected to said fan motor for providing electrical power to said fan motor, a keypad including a plurality of adjustment keys electrically coupled to said control circuit, said adjustment keys being arranged in an array, respective keys in said array being associated with respective monotonically increasing fan speeds, whereby depressing a key at any position in the array will produce a fan speed related to the position of the depressed key in the array, wherein said control circuit responds to depression of two adjacent keys in said array by causing said fan motor to drive said fan at a speed intermediate the speeds associated with the two keys when pressed separately.

5. A ventilator for a human-habitable structure, comprising a fan motor, a fan driven by said fan motor, a control circuit electrically connected to said fan motor for providing electrical power to said fan motor, a keypad including a plurality of keys electrically coupled to said control circuit, said control circuit responding to depression of one or more of said keys to cause said fan motor to drive said fan at a fan speed, wherein said plurality of keys of said keypad includes an automatic fan control key, said control circuit responding to depression of said automatic fan control key and in response causing said fan motor to drive said fan at a progression of two or more different fan speeds over time in accordance with a preprogrammed schedule.

6. The ventilator of claim 5 wherein said control circuit responds to depression of said automatic fan control key by causing said fan motor to drive said fan at gradually reducing fan speeds over time until, ultimately, said control circuit causes said fan motor to stop driving said fan.

7. A range hood, comprising a light, a control circuit electrically connected to said light for providing electrical power to said light, a keypad including a plurality of adjustment keys electrically coupled to said control circuit, said control circuit responding to depression of a group of at least two of said adjustment keys and in response causing said light to energize at one of a plurality of possible intensities.

8. The range hood of claim 7 wherein said adjustment keys are arranged in a linear array having a first and a second end, said control circuit responding to depression of a key at said first end of said array by causing said light to energize at a lowest possible intensity, and said control circuit responding to depression of a key at said second end of said array by causing said light to energize at a highest possible intensity.

9. The range hood of claim 8 wherein respective keys in said array from said one end to said opposite end are associated with respective monotonically increasing intensities, whereby depressing a key at any position in the array will produce an intensity related to the position of the depressed key along the array.

10. The range hood of claim 7 further comprising a fan motor and a fan driven by said fan motor, wherein said control circuit is electrically connected to said fan motor for providing electrical power to said fan motor, said control circuit also responding to depression of a group of at least two of said adjustment keys and in response causing said fan motor to drive said fan at one of a plurality of possible fan speeds.

11. The range hood of claim 7 further comprising a light ON key and a light OFF key, said control circuit responding to depression of said light ON key by energizing said light at a predetermined intensity, said control circuit responding to depression of said light OFF key by deenergizing said light.

12. A range hood, comprising a light, a control circuit electrically connected to said light for providing electrical power to said light, a keypad including a plurality of adjustment keys electrically coupled to said control circuit, said adjustment keys being arranged in an array, respective keys in said array being associated with respective monotonically increasing fan speeds, whereby depressing a key at any position in the array will produce a fan speed related to the position of the depressed key in the arrays, wherein said control circuit responds to depression of two adjacent keys in said array by causing said light to energize at an intensity intermediate the intensities associated with the two keys when depressed separately.

13. A range hood, comprising a fan motor, a fan driven by said fan motor, a light, a control circuit electrically connected to said fan motor for providing electrical power to said fan motor, and electrically connected to said light for providing electrical power to said light, a keypad including a plurality of adjustment keys electrically coupled to said control circuit, and further comprising a light key, said control circuit responding to depression of said light key combined with depression of one or more of said adjustment keys to cause said light to energize at one of a plurality of possible intensities, said control circuit responding to depression of said adjustment keys, when not combined with depression of said light key, to cause said fan motor to drive said fan at one of a plurality of possible fan speeds.

14. The range hood of claim 13 wherein said control circuit responds to depression of said light key for longer than a predetermined time period, followed by depression of any said adjustment key, by causing said light to energize at a one of a plurality of possible intensities.

15. The range hood of claim 14 wherein said control circuit responds to depression of said light key for shorter than said predetermined time period by causing said light to energize at a previously selected intensity.

16. A range hood, comprising a fan motor, a fan driven by said fan motor, a light, a control circuit electrically connected to said fan motor for providing electrical power to said fan motor, and electrically connected to said light for providing electrical power to said light, a keypad including a plurality of keys electrically coupled to said control circuit, said control circuit responding to depression of one or more of said keys to cause said fan motor to drive said fan at a desired fan speed, said control circuit also responding to depression of one or more of said keys to energize said light at a desired intensity, wherein said plurality of keys of said keypad includes an automatic fan control key, said control circuit responding to depression of said automatic fan control key and in response causing said fan motor to drive said fan at a progression of two or more different fan speeds over time in accordance with a preprogrammed schedule.

17. The range hood of claim 16 wherein said control circuit responds to depression of said automatic fan control key by causing said fan motor to drive said fan at gradually reducing fan speeds over time until, ultimately, said control circuit causes said fan motor to stop driving said fan.

18. A ventilator for a human-habitable structure, comprising a fan motor, a fan driven by said fan motor, a control circuit electrically connected to said fan motor for providing electrical power to said fan motor, a keypad including an automatic fan control key, said control circuit responding to depression of said automatic fan control key and in response causing said fan motor to automatically drive said fan at a progression of two or more different fan speeds over time in accordance with a preprogrammed schedule.

19. The ventilator of claim 18 wherein said control circuit responds to depression of said automatic fan control key by causing said fan motor to drive said fan at gradually reducing fan speeds over time until, ultimately, said control circuit causes said fan motor to stop driving said fan.

20. A method of controlling a ventilator for a human-habitable structure including a fan driven by a fan motor, comprising providing a control circuit electrically connected to said fan motor for supplying electrical power to said fan motor, providing a keypad including a plurality of adjustment keys electrically coupled to said control circuit, in said control circuit, responding to simultaneous depression of a group of at least two of said adjustment keys and in response causing said fan motor to drive said fan at one of a plurality of possible fan speeds.

21. A method of controlling a range hood light, comprising providing a control circuit electrically connected to said light for supplying electrical power to said light, providing a keypad including a plurality of adjustment keys electrically coupled to said control circuit, in said control circuit, responding to depression of a group of at least two of said adjustment keys and in response causing said light to energize at one of a plurality of possible intensities.

22. A method of controlling a ventilator for a human-habitable structure including a fan driven by a fan motor, comprising providing a control circuit electrically connected to said fan motor for supplying electrical power to said fan motor, providing a keypad including an automatic fan control key, in said control circuit, responding to depression of said automatic fan control key and in response causing said fan motor to automatically drive said fan at a progression of two or more different fan speeds over time in accordance with a preprogrammed schedule.

* * * * *